US005706754A

United States Patent [19]

Menne, Jr.

[11] Patent Number: 5,706,754

[45] Date of Patent: Jan. 13, 1998

[54] PONTOON BOAT WITH RAIL ELEVATED ABOVE DECKING BY RAIL SHIMS AND PROCESS

[75] Inventor: Robert J. Menne, Jr., Forest Lake, Minn.

[73] Assignee: Premier Marine, Inc., Wyoming, Minn.

[21] Appl. No.: 681,843

[22] Filed: Jul. 29, 1996

[51] Int. Cl.[6] ..... B63B 17/00

[52] U.S. Cl. ..... 114/364; 114/61

[58] Field of Search ..... 114/56, 61, 39.1, 114/343, 364

[56] References Cited

U.S. PATENT DOCUMENTS

| | | | |
|---|---|---|---|
| D. 359,228 | 6/1995 | Dunlap | D8/373 |
| 2,784,930 | 3/1957 | Wernecke | 248/300 |
| 3,345,967 | 10/1967 | Sweet | 114/61 |
| 3,807,338 | 4/1974 | Shader | 114/283 |
| 4,395,585 | 7/1983 | Polcyn | 174/138 G |
| 5,372,392 | 12/1994 | Dunn et al. | 285/334.1 |
| 5,402,976 | 4/1995 | Pollack | 248/300 |

FOREIGN PATENT DOCUMENTS

| | | | |
|---|---|---|---|
| 449305 | 6/1948 | Canada . | |
| 909593 | 3/1954 | Germany | 248/300 |

*Primary Examiner*—Jesus D. Sotelo
*Attorney, Agent, or Firm*—Hugh D. Jaeger

[57] ABSTRACT

A rail shim or spacer made of aluminum, plastic or other suitable material used to space the lower box rails of a pontoon boat above the main decking to allow water drainage and air flow.

10 Claims, 4 Drawing Sheets

PONTOON BOAT WITH RAIL ELEVATED ABOVE DECKING BY RAIL SHIMS AND PROCESS

CROSS REFERENCES TO CO-PENDING APPLICATIONS

None.

BACKGROUND OF THE INVENTION

1. Field of the Invention

The present invention pertains to a rail shim or spacer mounted between the lower box rails and decking of a pontoon boat to space the rails from the decking and thereby allow adequate drainage and airflow which, in turn, prevents the collection of water on the pontoon decking. By preventing the collection of water on the pontoon decking, the lifespan of the pontoon's decking and carpet are extended.

2. Description of the Prior Art

Lower box rails have been directly bolted to the decking of a pontoon boat, causing numerous problems and concerns.

SUMMARY OF THE INVENTION

The general purpose of the present invention is a shim mounted between the main decking and box rail of a pontoon boat to allow for adequate drainage and airflow.

According to of the present invention, there is provided a rail shim for a pontoon boat and a process of using the rail shim to elevate the lower rails of the pontoon boat above the decking.

BRIEF DESCRIPTION OFT HE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
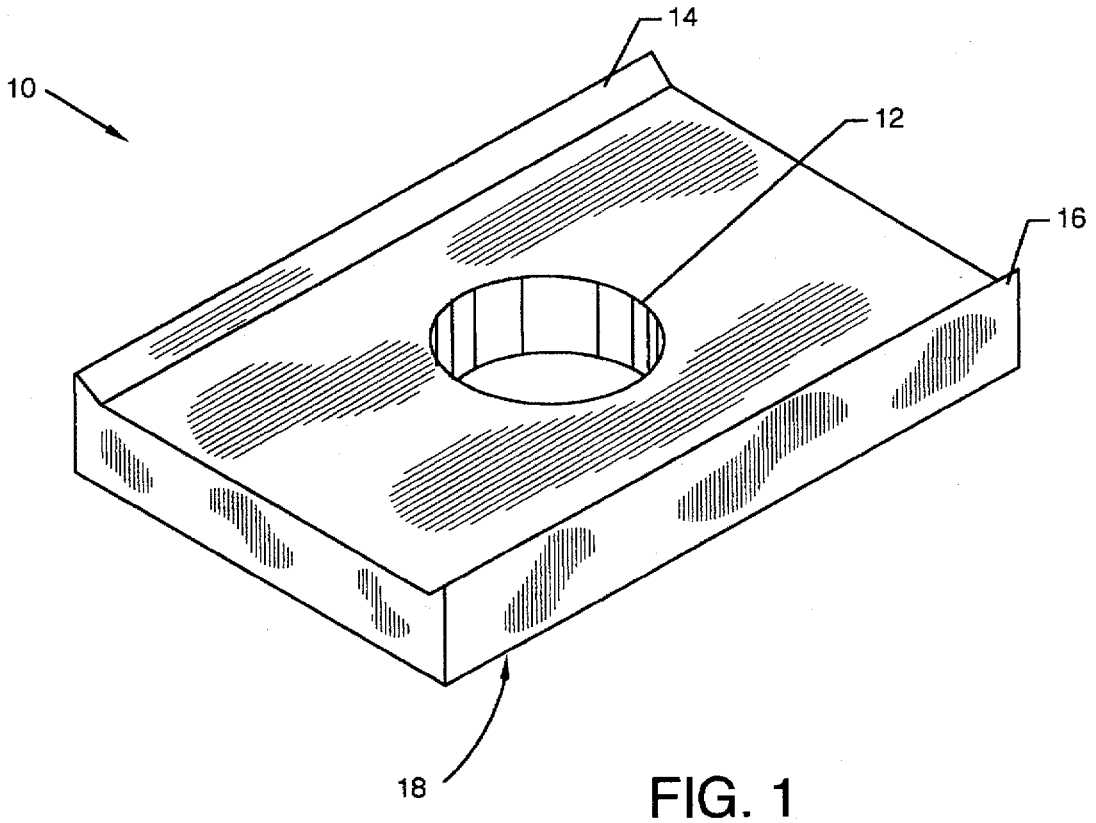
FIG. 1 illustrates an isometric view of a rail shim.

FIG. 1 illustrates an isometric view of a rail shim or spacer 10, which is constructed of aluminum, plastic or other suitable material. The rail shim or spacer 10 is in the form of a substantially rectangular block and incorporates a planar top surface, a substantially centrally located hole 12, two raised edges 14 and 16, which are beveled or otherwise suitably shaped, and a flat planar surface 18 on the bottom portion, as shown in FIG. 1.

Figure 2:
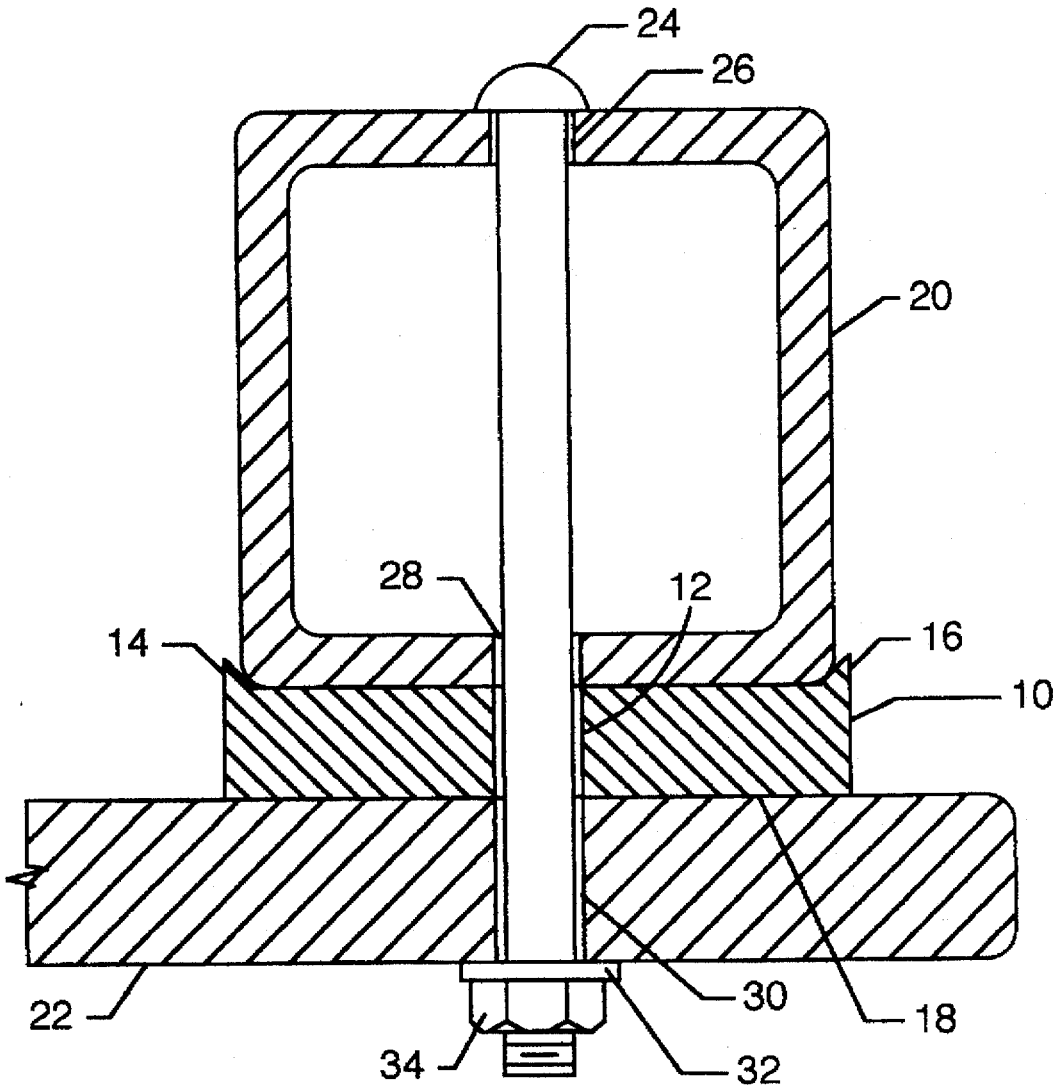
FIG. 2 illustrates a cross sectional view of the rail shim engaged between a lower box rail and the pontoon's decking.

FIG. 2 illustrates a cross sectional view of the rail shim or spaced 10 engaged between a lower box rail 20 and a pontoon's decking 22, where all numerals correspond to those elements previously described. A bolt 24 extends downwardly through holes 26 and 28 in box rail 20, hole 12 of rail shim 10, and a hole 30 on the pontoon's decking 22 where a washer 32 and a nut 34 frictionally secure the assembly. Illustrated in detail are edges 14 and 16 which provide alignment of the box rail 20.

Figure 3:
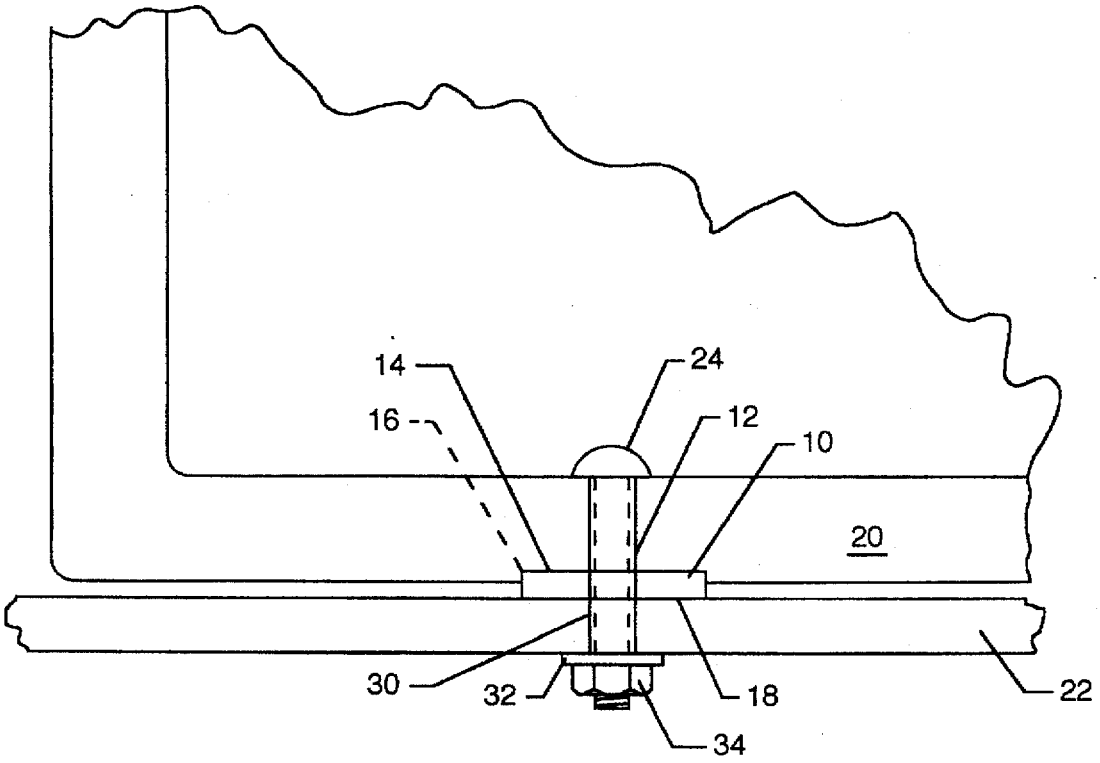
FIG. 3 illustrates a side view in partial cut-away of the rail shim engaged between a lower box rail and the pontoon's decking; and, FIG. 4 illustrates the mode of operation of the present invention.

FIG. 3 illustrates a side view in partial cut-away of the rail shim or spacer 10 engaged between a lower box rail 20 and the pontoon's decking 22, where all numerals correspond to those elements previously described. FIG. 3 illustrates in detail the fit of the rail shim 10 between box rail 20 and the pontoon's decking 22 where planar surface 18 lies directly atop decking 22.

MODE OF OPERATION

Figure 4:
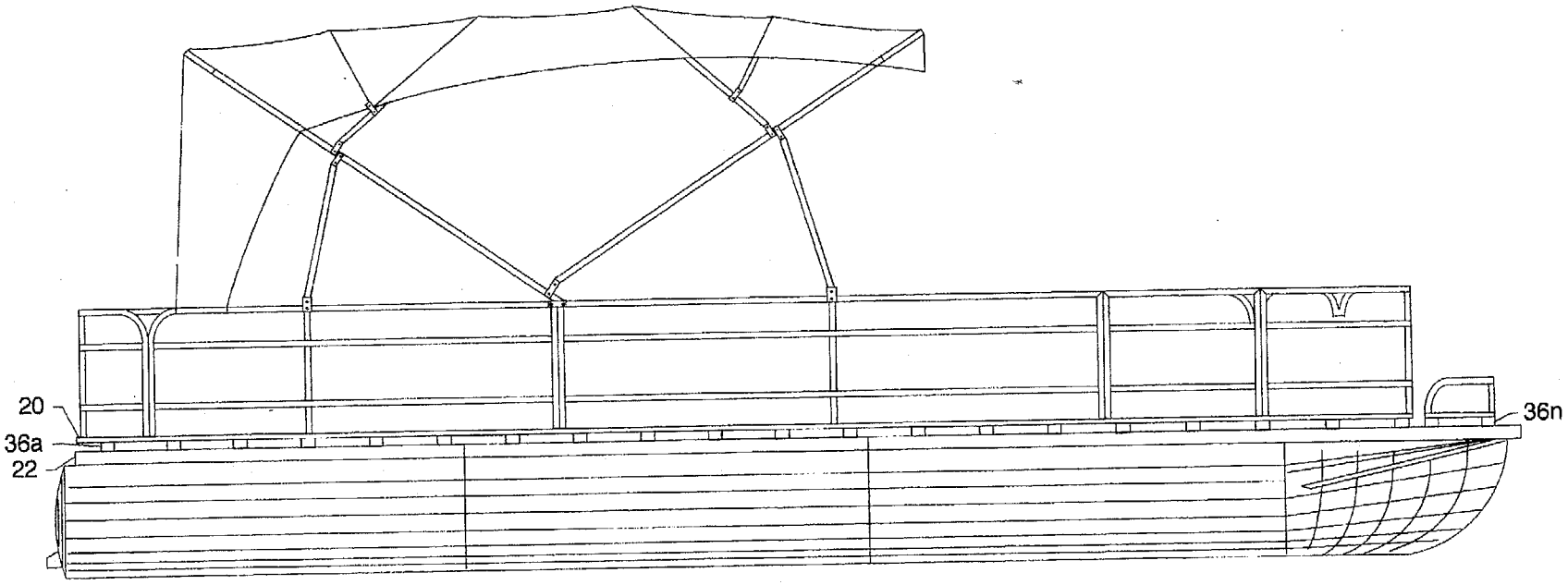

FIG. 4 illustrates a plurality of rail shims or spacers generally distributed at stations **36*a*–36*n* between box rail 20** and the pontoon's decking as required for proper support, drainage and airflow. The size of the rail shims is larger than actual size with respect to the pontoon boat for clarity purposes.

Various modifications can be made to the present invention without departing from the apparent scope hereof.

I claim:

1. Process for elevating a lower box rail for a pontoon boat above a main deck of the pontoon boat comprising:

a. placing a spacer on the main deck of a pontoon boat;

b. placing the lower box rail on said spacer; and, c. placing a bolt through the lower box rail, said spacer, and said main deck.

2. Process for elevating a lower rail for a pontoon boat above a main deck of the pontoon boat comprising:

a. placing a plurality of spacers on the main deck of a pontoon boat at spaced apart locations along the main deck;

b. placing the lower rail across the plurality of spacers; and, c. placing a bolt through the lower rail, the spacer, and the main deck at the location of each spacer.

3. Process for elevating a lower rail for a pontoon boat above a main deck of the pontoon boat as set forth in claim 2 and further comprising:

a. placing a nut on each bolt; and, b. tightening the nuts to secure the lower rail, spacers and main deck tightly together.

4. In combination, a pontoon boat having a main deck, a rail extending along the main deck, and a plurality of spacers positioned at spaced apart locations between the rail and the main deck for elevating the rail from the main deck and thereby allowing for water drainage and airflow between the rail and the main deck.

5. The combination as set forth in claim 4, wherein each spacer of the plurality of spacers has a hole extending therethrough, wherein the rail and the main deck have corresponding holes aligned with the holes in the spacers, and wherein bolts pass through the aligned holes in the rail, the spacers and the main deck, each bolt receiving a nut which is tightened thereon to secure the rail and spacers to the main deck.

6. The combination as set forth in claim 4, wherein each spacer of the plurality of spacers comprises a substantially rectangular block having a top surface, a bottom surface seated against the main deck, a substantially centrally located hole extending therethrough from the top surface through the bottom surface, and two longitudinally extending raised edges projecting above the top surface which receive the rail therebetween.

7. The combination as set forth in claim 6, wherein the longitudinally extending raised edges are beveled inwardly toward the top surface.

8. The combination as set forth in claim 6, wherein the top and bottom surfaces are planar.

9. The combination as set forth in claim 4, wherein the rail is a box rail.

10. The combination as set forth in claim 4, wherein the spacers and the rail are securely fastened to the main deck by bolts.

* * * * *